United States Patent [19]

Roberts

[11] 4,090,648

[45] May 23, 1978

[54] DECANTER AND MOLDED INTERLOCKING HANDLE

[75] Inventor: M. F. Roberts, Niles, Ill.

[73] Assignee: Bloomfield Industries, a Division of Beatrice Foods Co., Chicago, Ill.

[21] Appl. No.: 675,473

[22] Filed: Apr. 9, 1976

[51] Int. Cl.[2] ..... B65D 25/42

[52] U.S. Cl. ..... 222/570; 285/331

[58] Field of Search ..... 222/566, 570, 572, 465, 222/567; 285/DIG. 16, 297, 294, 331, DIG. 12

[56] References Cited

U.S. PATENT DOCUMENTS

| | | | |
|---|---|---|---|
| 332,754 | 12/1885 | Scott | 285/331 |
| 1,463,692 | 7/1923 | Hail | 285/DIG. 16 |
| 2,314,328 | 3/1943 | Enderle | 285/331 X |
| 3,308,982 | 3/1967 | Kitabayshi | 222/570 X |
| 3,473,833 | 10/1969 | Bremer | 285/331 X |
| 3,491,924 | 1/1970 | Bloomfield et al. | 222/567 |
| 3,784,235 | 1/1974 | Kessler et al. | 285/DIG. 16 X |
| 3,800,988 | 4/1974 | Karlen et al. | 222/570 X |

FOREIGN PATENT DOCUMENTS

| | | | |
|---|---|---|---|
| 1,078,580 | 5/1954 | France | 285/DIG. 16 |

*Primary Examiner*—Robert R. Song
*Assistant Examiner*—Norman L. Stack, Jr.
*Attorney, Agent, or Firm*—Lee & Smith

[57] ABSTRACT

A decanter vessel formed of a rigid receptacle and a pouring spout unit matingly engaged about the neck of the receptacle in a sealing fashion. The pouring spout has formed therein an internal annular cavity shaped to accommodate the neck portion of the receptacle. The receptacle and pouring spout are joined by a flexible adhesive material which surrounds the neck portion of the receptacle forming both an adhesive and a mechanical bond between the receptacle and the pouring spout, sealing their junction to prevent leakage of liquid therebetween. During assembly of the decanter, the flexible adhesive material is in a liquid state to facilitate joining of the receptacle and pouring spout and assure that the material evenly and completely surrounds the neck portion and fills the annular cavity. The flexible adhesive material solidifies after assembly of the decanter vessel.

8 Claims, 3 Drawing Figures

DECANTER AND MOLDED INTERLOCKING HANDLE

SUMMARY OF THE INVENTION

THE BACKGROUND

This invention relates to a decanter vessel for containing and dispensing liquids, and more particularly to an improved decanter vessel formed of a unitary pouring spout bonded to a rigid glass receptacle. A decanter, according to the present invention, is particularly useful for dispensing hot liquids such as coffee.

In the field of glass decanters, it is well known that a decanter may be formed by affixing to the neck portion of a receptacle component thereof a pouring spout or neck band assembly to facilitate dispensing of liquids from the decanter. In the conventional decanter, the pouring spout assembly includes an annular band of material, severed at one point to allow expansion and contraction thereof. The annular band is normally mounted on the neck portion of a glass receptacle surrounding a soft, pliable gasket which, when the decanter vessel is assembled, forms a seal between the band and the neck portion of the receptacle. The band is brought together and joined in sealing fashion by a bolt or rivet. A conventional decanter of this nature is illustrated, for example, in Harold Bloomfield, et al U.S. Pat. No. 3,632,025, owned by the assignee of the present invention.

While the decanter of Bloomfield U.S. Pat. No. 3,632,025 has been well accepted commercially, there are several heretofore unsolved problems with such a prior art structure. For example, a number of parts must be utilized to form the decanter vessel, resulting in larger than necessary material and fabrication costs for the commercial product. Secondly, because the seal between the neck band and the neck portion of the receptacle is provided by a flexible gasket, a defective gasket or improper assembly of the decanter vessel can result in loosening of the neck band and leakage of liquid between the neck band and the neck of the decanter; in any event, such a construction tends to leak after long or hard use. Thirdly, due to the necessity of a separate, flexible gasket in the decanter vessel, this type of device has required a relatively elongated, vertical neck portion to be formed in the glass receptacle, leading to difficulty in pouring liquid from the decanter. Not only is the decanter difficult to empty completely without substantially inverting it, rapid pouring of the liquid within the receptacle from the decanter tends to cause the liquid to separate from the pouring spout portion of the neck band and pour directly from the receptacle, not passing over the spout. The resulting turbulant flow of the liquid poured from the decanter vessel tends to cause excessive splashing.

Attempts to overcome the shortcomings of prior art decanter devices have met with varying degress of success. For example, Fiorini U.S. Pat. No. 3,615,045 is directed to an apparatus with a unitary pouring spout structure which is force-fitted onto the neck of the glass receptacle with a flexible gasket therebetween. However, due to the nature of the structure, assembly is difficult and results in a number of broken decanters. Furthermore, if the close tolerances required to obtain a tight force fit between the pouring spout and the neck of the glass receptacle are not met, a loose and therefore leaking seal results. Also, since a tall neck portion is required of the glass receptacle, the same pouring difficulties inherent in the device of Bloomfield U.S. Pat. No. 3,632,025 occur when liquid is rapidly poured from a Fiorini type decanter.

The applicant is also aware of a number of glass decanters produced by the Wilbur Curtis Co., Inc. of Los Angeles, Calif. in which a unitary pouring spout structures was affixed to a glass receptacle with an epoxy resin. However, it was found that the epoxy formed a rigid seal between the pouring spout and the glass receptacle causing the neck to break from the glass receptacle as the pouring spout contracted during shipping in sub-freezing temperatures. In addition, the epoxy resin does not adhere well to polypropylene material which normally forms the unitary pouring spout, allowing the seal between the pouring spout and the glass decanter to readily be broken and causing fluid leakage therebetween.

The applicant is further aware of additional patents relating to decanter vessels of the prior art. These are Glass U.S. Pat. 2,807,944, Fischer U.S. Pat. No. 2,998,169, Eisendrath, et al U.S. Pat. No. 3,059,822, Anderson, et al U.S. Pat. No. 3,154,227, Bloomfield, et al U.S. Pat. Nos. 3,330,449 and 3,491,924, Hester U.S. Pat. No. 3,516,580, and Bloomfield Canadian Pat. No. 785,082. Each of the decanter vessels disclosed in these patents is of conventional nature of Bloomfield, et al U.S. Pat. No. 3,632,025, and suffers the same disadvantages outlined above.

THE INVENTION

The inherent disadvantages of prior decanter vessels are solved according to the present invention by providing a decanter vessel having a rigid receptacle with an integral neck portion formed thereon, a pouring spout unit having an annular cavity shaped to receive the neck portion of the rigid receptacle, and a flexible means joining the rigid receptacle and the spout unit together. The flexible means generally surrounds the neck portion within the cavity to form a mechanical lock and a fluid seal therebetween. The flexible means also adheres to the receptacle and the pouring spout unit to form a strong bond.

Preferably, the neck portion of the decanter vessel is formed with a generally annular upstanding flange which is disposed in the annular cavity formed in the pouring spout unit. The annular cavity is shaped to surround the neck portion, and it includes a plurality of spaced rib members formed transversely thereacross to preclude relative movement between the receptacle and the spout unit during assembly of the decanter vessel. The rib members extend only a small distance into the interior of the channel.

The pouring spout unit includes a first annular sealing fin formed adjacent to the channel which is shaped to engage or almost engage the inner surface of the neck portion of the rigid receptacle, and a second annular sealing fin formed exteriorly of the channel in the pouring spout which engages the outer surface of the glass receptacle.

Since the rigid receptacle is normally composed of glass which expands and contracts very little over a wide range of temperatures, the flexible material utilized to bond the pouring spout to the receptacle must be flexible enough to withstand the expansion and contraction of the pouring spout unit which is engaged about the neck of the rigid receptacle vessel throughout the wide range of temperatures. Furthermore, the flexible material must bond to both the rigid receptacle and the pouring spout without reacting chemically with either. It must not impart any taste or odor to the liquid contained in the receptacle, nor can it change from its normally soild state to a liquid state over the wide range of temperatures to which the decanter vessel may be subjected. Applicant has found that silicone adhesives, such as sold by the General Electric Company, have the requisite flexibility over a large temperature range, but such silicone materials have an acidic odor and taste which is imparted to any liquid dispensed from the decanter vessel. The most suitable material, which meets the rigid performance requirements outlined above, is a hot-melt adhesive manufactured by the Minnesota Mining & Manufacturing Company and sold under the trade name "Jet-melt". Formulation No. 3739 of the "Jet-melt" system has been found to be particularly useful. it is a polyamide-based material which bonds well to the polypropylene material normally used to mold the pouring spout unit to the glass receptacle.

In forming the decanter vessel, the flexible adhesive material is applied in a liquid state into the channel in the rigid receptacle, substantially filling the channel. Thereafter, the neck portion of the rigid receptacle is inserted into the channel so that the flexible adhesive material completely fills the void and surrounds the inserted neck portion. When solid, the flexible material forms a permanent sealing bond between the receptacle and the pouring spout unit.

By reason of the various features of the invention as described in detail hereafter, a decanter vessel according to the invention is provided which is less costly than prior art apparatus, easier to assemble than known prior art, and useable at all temperature extremes without fracture of the neck portion from the glass receptacle.

DETAILED DESCRIPTION OF THE INVENTION

Figure 1:
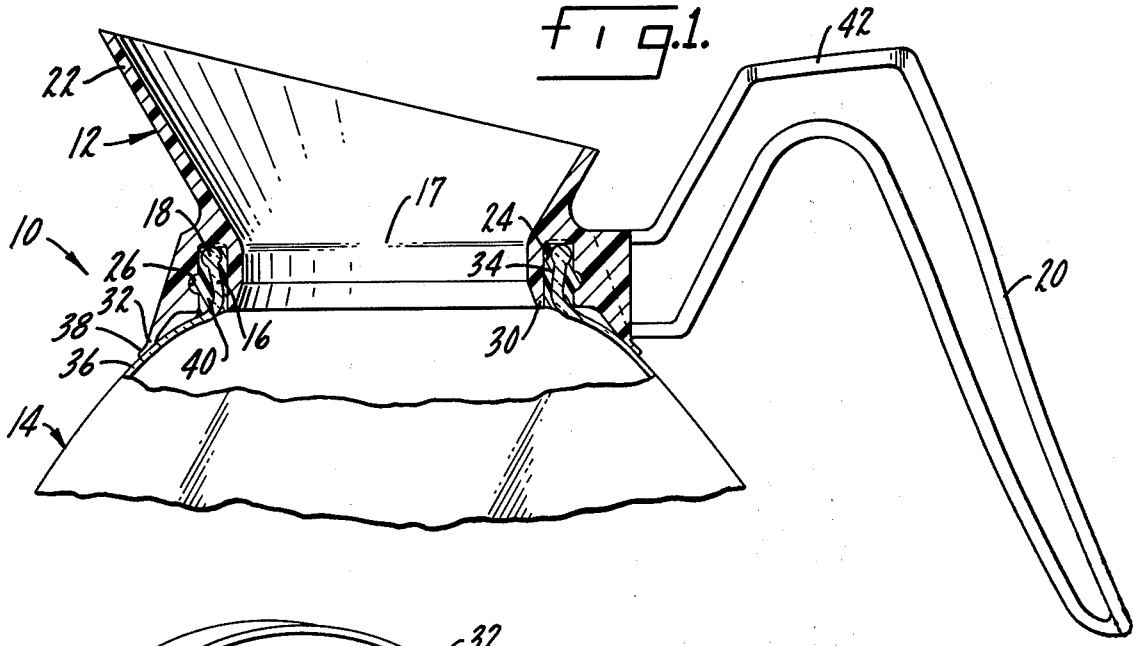
FIG. 1 is a cross-sectional view of the upper portion of a decanter vessel according to the invention.
Figure 3:
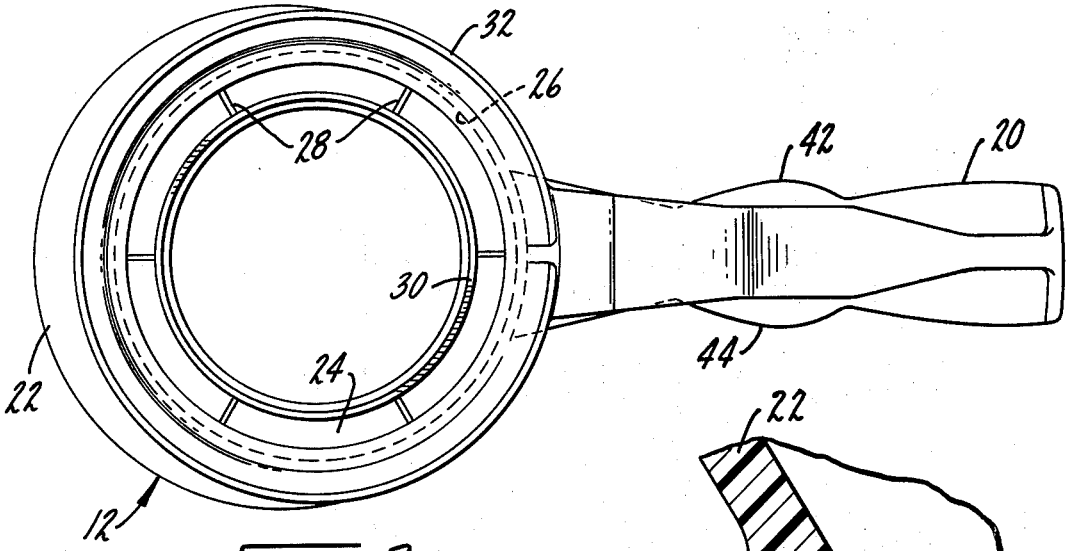
FIG. 3 is a bottom view of the pouring spout and handle unit of the decanter vessel of FIG. 1.
Figure 2:
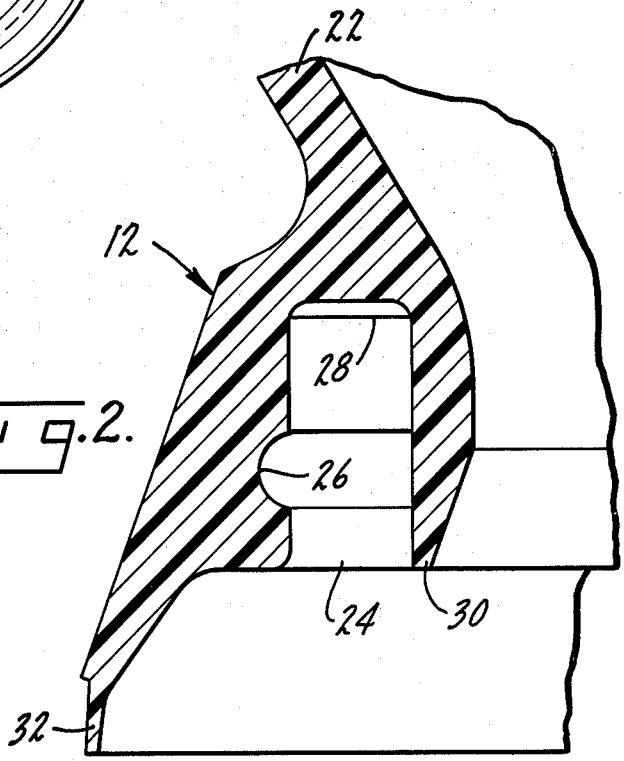
FIG. 2 is an enlarged fragmentary cross-sectional view of a portion of the pouring of the decanter vessel of FIG. 1.

As illustrated in the drawings, a decanter vessel 10 is composed of two basic components, a pouring spout or neck band unit 12 and a rigid receptacle 14. The receptacle 14, preferably formed of glass or any other rigid, transparent material, has an integral upstanding neck portion or flange 16 formed thereon in a continuous and annular manner about the open top or dispensing aperture 17 of the receptacle. The neck portion 16 may have an enlarged integral annular bead portion 18 as illustrated, or may be formed with a generally constant thickness.

The pouring spout unit 12 is a unitary body formed of semi-rigid material, such as polypropylene. A handle 20 is affixed to the pouring spout unit 12. The handle may be a separate element to be fixedly secured to the spout unit, but preferably, as shown, it is formed as an integral portion of the spout unit. As is customary with decanter vessels, an annular dispensing or pouring flange 22 is integrally formed in the neck band unit 12 with an extended pouring lip portion formed opposite to the handle 20.

The pouring spout unit has formed therein an internal annular cavity 24 which, when the decanter vessel is assembled as illustrated in FIG. 1, receives and surrounds the neck portion 16 of the rigid receptacle 14. The cavity 24 includes a shallow annular channel or groove 26 which enhances the mmechanical connection between the neck portion 16 of the rigid receptacle 14 and the pouring spout unit 12 as will be further described.

The annular cavity 24 has formed therein a plurality of shallow transverse ribs 28 which extend downwardly at spaced intervals into the annular cavity 24. The ribs 28 are integral with the spout unit 12 and engage the top of neck portion 16 of the rigid receptacle 14 during assembly of the decanter vessel 10 in order to reduce the likelihood of relative verticle movement between the pouring spout The pouring spout unit 12 includes an internal integral annular sealing fin 30 and an external integral annular sealing fin 32. As illustrated in FIG. 1, the internal annular sealing fin 30 is shaped to be normally in engagement with or slightly spaced from the inner surface 34 of the neck portion 16 of the rigid receptacle 14. The external annular sealing fin 32 engages the outer surface 36 of the rigid receptacle 14 as shown.

As illustrated, the cavity 24 of the spout unit is significantly wider than necessary to accommodate the neck portion 16 of the receptacle. This is to assure that varying diameter and varying thickness neck portions 16 can be accepted within the cavity 24. Although rigid receptacles 14 all may be formed to exactly the same specifications, due to the formulation of the material of the rigid receptacles and conditions which exist as they are formed, a substantial variation in the size of the neck portion 16 is ordinarily encountered, particularly when the receptacle is formed of glass. In addition, manufacturing tolerances are required in the molding of the spout unit 12. Therefore, the internal annular sealing fin 30 will not necessarily engage the inner surface 34 of the neck portion 16 for each decanter vessel 10 in order to accommodate the necessary manufacturing tolerances of both the receptacle and the spout unit.

The annular fin 32 is flexible in order to accommodate varying dimensions of the neck portion 16 and the adjacent portion of the rigid receptacle 14. For example, the neck portion 16 may be on the long side of the height tolerance such that when the decanter vessel is assembled, and the upper edge of the neck portion 16 engages the transverse ribs 18, the bottom edge of the external annular sealing fin 32 just engages the outer surface 36 of the rigid receptacle 14. On the other hand, as illustrated in FIG. 1, the neck portion 16 may be on the short side so that when the ribs 28 are engaged by its upper edge the sealing fin 32 is distended outwardly as at 38.

As can be appreciated, other size variations of the neck portion 16 of the rigid receptacle 14 can be tolerated by the flexible nature of the annular sealing fins 30 and 32 without inhibiting the assembly or utilization of the decanter When the decanter vessel is constructed as illustrated in FIG. 1, a flexible bonding material 40 completely fills the void in the annular cavity 24 and surrounds the neck portion 16 to interlockingly join the rigid receptacle 14 and the pouring spout unit. Preferably, the flexible material 40 is a polyamidebased material which adheres to both the rigid receptacle and the pouring spout 12 and yet is flexible enough to endure a wide variation of ambient temperatures. The flexible bonding material provide a cushion to prevent the pouring spout unit 12 from breaking the neck portion 16 from the rigid receptacle 14 as the pouring spout 12 expands and contracts with temperature variations. Furthermore, the bonding material must allow ready assembly of the decanter vessel 10 in an expeditious and economical manner. While any flexible bonding material which adheres to both the rigid receptacle 14 and the molded pouring spout unit 12 can be employed so long as it does not impart any adverse taste or odor to the liquid dispensed from the decanter vessel 10, applicant has investigated a number of materials thus far but has found that only polyamid-based materials satisfy the fairly stringent requirements.

To assemble the decanter vessel 10, the internal annular cavity 24 of the spout unit 12 is first filed with a liquified flexible material 40. Immediately thereafter, the neck portion 16 of the rigid receptacle 14 is inserted into the cavity 24 until it engages the transverse ribs 28. The vessel is maintained in this position until the flexible material 40 solidified, at which time the decanter vessel 10 is ready for use without any further manufacturing step.

To assure a rigid yet flexible interconnection between the pouring spout unit 12 and the rigid receptacle 14, the neck portion 16 of the receptacle is preferably provided with the enlarged bead 18. In addition, the internal annular cavity is preferably provided with the shallow annular channel or groove 16. When the flexible material 40 has solidified in the internal annular cavity 24, the enlarged bead 18 and the shallow annular channel 26 cooperate to assure a strong mechanical lock between the rigid receptacle 14 and the pouring spout 12. Thus, even if a strong adhesive bond is not formed between the flexible means 40 and either of the rigid receptacle 14 or the pouring spout unit 12, the spout unit and the rigid receptacle will be firmly interlocked to prevent separation therebetween.

The handle 20 allows one to dispense liquid from the decanter vessel 10 in a normal, forward manner over the dispensing lip portion of the flange 22, or to either side. To facilitate pouring of liquid to either side, the handle 20 has formed therein integral thumb ledges 42 and 44. The user, employing the right or left hand as desired, places the thumb against the appropriate thumb ledge 42 or 44 to increase the leverage for tipping the decanter vessel 10 to either side.

In the conventional decanter vessel, the neck portion of the glass receptacle is normally substantially taller than the neck portion 16 of the rigid receptacle 14 of the present invention. As a result, the inner neck portion of the conventional decanter vessel has a substantial vertical length between the rigid receptacle and the dispensing lip. It has been found that this vertical length inhibits rapid pouring of liquid from the assembled decanter vessel. In pouring rapidly from such a conventional decanter, the liquid tends to separate from the dispensing lip and to flow directly from the rigid receptacle, with ensuing splashing of liquid. With the present invention, applicant has found that, short of total inversion of a filled decanter vessel 10, liquids can be rapidly dispensed from the vessel without the liquid flow separating from the dispensing lip 22, no matter which direction the decanter vessel 10 is tipped for pouring. As far as applicant is able to ascertain, this is due to the relatively smooth transition between the rigid receptacle 10 and the dispensing lip 22, and the relatively short vertical height of the neck portion 16.

Various modifications and changes may be made to the structure of the present invention without departing from the true spirit thereof or the scope of the following claims.

I claim:

1. A decanter vessel comprising (a) a rigid receptacle having an integral neck portion formed thereon, (b) a pouring spout unit having formed therein a continuous cavity shaped to freely accommodate said neck portion without stress, the width of said cavity being greater than the thickness of said neck portion, forming a gap between said neck portion and the wall of said cavity, and (c) flexible means joining said rigid receptacle and said pouring spout unit, said flexible means (i) generally surrounding said neck portion within said cavity and substantially filling the remainder of said cavity unoccupied by said neck portion, and (ii) adhering to said neck portion and said pouring spout unit, forming a mechanical lock therebetween and sealing the gap between the neck portion of the rigid receptacle and pouring spout unit to prevent liquid flow therebetween.

2. A decanter vessel according to claim 1 in which said neck portion is a generally annular protrusion extending from said receptacle, and said cavity is of annular configuration and shaped to surround said neck portion.

3. A decanter vessel accordiing to claim 2 including an annular channel formed within the inner margin of said cavity to coact with said flexible means to strengthen the mechanical lock between said neck portion and said spout unit.

4. A decanter vessel according to claim 2 in which said cavity includes a plurality of spaced rib members formed transversely across said cavity to preclude relative movment between said receptacle and said spout during formation of said vessel.

5. A decanter vessel according to claim 4 in which the height of each of said rib members is substantially less than the depth of said cavity.

6. A decanter vessel according to claim 2 including sealing means formed on said pouring spout unit for engaging the surface of the receptacle.

7. A decanter vessel according to claim 6 in which said sealing means comprises:

first annular fin means formed on said pouring spout unit adjacent said cavity for engaging the inner surface of said neck portion, and second annular fin means formed on said pouring spout for engaging the outer surface of the receptacle.

8. A decanter vessel according to claim 6 in which said annular cavity includes a plurality of spaced rib members formed transversely across said cavity to preclude relative movement between said receptacle and said spout during formation of said vessel.

* * * * *